US007831156B2

(12) United States Patent
Igarashi et al.

(10) Patent No.: US 7,831,156 B2
(45) Date of Patent: Nov. 9, 2010

(54) IMAGE FORMING APPARATUS HAVING ENHANCED MANAGEMENT FOR CONSUMABLE-SUPPLIES

(75) Inventors: Yasuyuki Igarashi, Kawasaki (JP); Yoshiya Inoue, Yokohama (JP); Toshio Kitazawa, Ichikawa (JP); Takeshi Fujita, Tokyo (JP); Yuka Saitoh, Kamakura (JP)

(73) Assignee: Ricoh Company, Ltd., Tokyo (JP)

( * ) Notice: Subject to any disclaimer, the term of this patent is extended or adjusted under 35 U.S.C. 154(b) by 905 days.

(21) Appl. No.: 11/616,663

(22) Filed: Dec. 27, 2006

(65) Prior Publication Data

US 2007/0146398 A1 Jun. 28, 2007

(30) Foreign Application Priority Data

Dec. 27, 2005 (JP) ..... 2005-375091

(51) Int. Cl.
*G03G 15/00* (2006.01)

(52) U.S. Cl. ..... 399/24; 399/27; 399/81; 399/82

(58) Field of Classification Search ..... 399/23, 399/24, 36, 27, 31, 35, 81, 82, 87
See application file for complete search history.

(56) References Cited

U.S. PATENT DOCUMENTS 5,557,707 A 9/1996 Inoue et al.
6,041,200 A * 3/2000 Glass et al. ..... 399/82
6,324,356 B1 11/2001 Inoue
2002/0044301 A1 4/2002 Kitazawa
2002/0135792 A1 * 9/2002 Sommer et al. ..... 358/1.13
2003/0107756 A1 6/2003 Dan et al.
2003/0161002 A1 8/2003 Nishiwaki et al.
2004/0080774 A1 * 4/2004 Owen et al. ..... 358/1.14

FOREIGN PATENT DOCUMENTS

JP 2001-117448 4/2001

OTHER PUBLICATIONS

U.S. Appl. No. 08/004,569, filed Jan. 14, 1993, Hayashi, et al.

* cited by examiner

*Primary Examiner*—David M Gray
*Assistant Examiner*—Barnabas T Fekete
(74) *Attorney, Agent, or Firm*—Oblon, Spivak, McClelland, Maier & Neustadt, L.L.P.

(57) ABSTRACT

An image forming apparatus includes a sensor, a notification unit, and a controller. The sensor detects a supply-end condition of consumable supplies. The notification unit notifies a message based on the supply-end condition detected by the sensor, and provides an operation key used for setting a condition for the image forming apparatus. The notification unit includes a print-stop setting and a print-continue setting, settable for a consumable supply and used when a printing operation is suspended due to an occurrence of the supply-end condition. The controller suspends the printing operation based on the print-stop setting and continues the suspended printing operation based on the print-continue setting.

15 Claims, 10 Drawing Sheets

<ERROR>

| FIG. 9A |
| --- |
| FIG. 9B |

IMAGE FORMING APPARATUS HAVING ENHANCED MANAGEMENT FOR CONSUMABLE-SUPPLIES

The present disclosure generally relates to an image forming apparatus, and more particular to an image forming apparatus which has a management system for a supply-end condition of consumable supplies.

BACKGROUND OF THE INVENTION

The "background" description provided herein is for the purpose of generally presenting the context of the invention. Work of the presently named inventors, to the extent it is described in this background section, as well as aspects of the description which may not otherwise qualify as prior art at the time of filing, are neither expressly or impliedly admitted as prior art against the present invention.

In general, an image forming apparatus such as a printer may include consumable supplies (or consumable parts). The consumable supplies may include toner, or an image carrying member, for example.

The consumable supplies may be replaced or refilled at a given time when the consumable supplies are consumed or exhausted by an image forming operation such as printing. Such a given time may be referred as "consumable supply replacement time" or "replacement timing," hereinafter, as required.

When the consumable supplies are almost consumed or exhausted (e.g., a condition of supply-end or near-supply-end) during a printing operation, the image forming apparatus may display that it is consumable supply replacement time on a display unit of the image forming apparatus.

However, the image forming apparatus may still continue the printing operation even if the consumable supplies are not replaced in some cases, resulting in degraded image quality because of the non-replacement of the consumable supplies.

If the image forming apparatus continues the printing operation without replacing the consumable supplies, serious damage may occur to some devices or units (e.g., engine) of the image forming apparatus.

In some image forming apparatuses, if a message indicating that it is consumable supply replacement time is displayed on a display unit during a printing operation, the image forming apparatus may immediately stop the printing operation. In this case, the printing operation may not or cannot be resumed until the consumed consumable supplies are replaced with new ones.

As mentioned above, if a printing operation is not stopped when a supply-end condition of consumable supplies occurs, image quality may degrade or serious damage may occur to some devices or units of the image forming apparatus.

If a printing operation is stopped whenever a supply-end condition of consumable supplies occurs, a user cannot continue the printing operation if the user does not have a spare of the consumed consumable supply at hand. A background art may include an image forming apparatus, which may reduce a time required for replacing consumable supplies and may facilitate a purchasing process of consumable supplies.

Such background art may facilitate a purchasing process of consumable supplies by using a network at the replacement timing of consumable supplies.

However, such background art may not have a function for selecting a stop/continue option of a printing operation when consumable supplies need to be replaced.

SUMMARY OF THE INVENTION

The present disclosure relates to an image forming apparatus including a sensor, a notification unit, and a controller. The sensor detects a supply-end condition of consumable supplies. The notification unit conveys a message based on the supply-end condition detected by the sensor, and provides an operation key used for setting a condition for the image forming apparatus. The notification unit includes a print-stop setting and a print-continue setting, settable for each of the consumable supplies and used when a printing operation is suspended due to an occurrence of the supply-end condition. The controller suspends the printing operation based on the print-stop setting and continues the suspended printing operation based on the print-continue setting.

The present disclosure also relates to a method of managing a printing condition and consumable supplies for an image forming apparatus. The method includes sensing, conveying, providing, and controlling. The sensing step senses a supply-end condition of any of the consumable supplies. The conveying step conveys a message based on the supply-end condition detected by the sensing step. The conveying step includes a print-stop setting and a print-continue setting, settable for each of the consumable supplies and used when a printing operation is suspended due to an occurrence of supply-end condition. The providing step provides an operation key used for setting a condition for the image forming apparatus based on the message. The controlling step controls the suspended printing operation based on the print-stop setting and print-continue setting.

It is to be understood that both the foregoing general description of the inventions and the following detailed description are exemplary, but are not restrictive of the inventions.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings. The accompanying drawings do not wholly represent or in any way limit the scope of the inventions embraced by this specification. The scope of the inventions embraced by this specification and drawings are defined by the words of the properly construed accompanying claims.

DETAILED DESCRIPTION OF THE INVENTION

Figure 1:
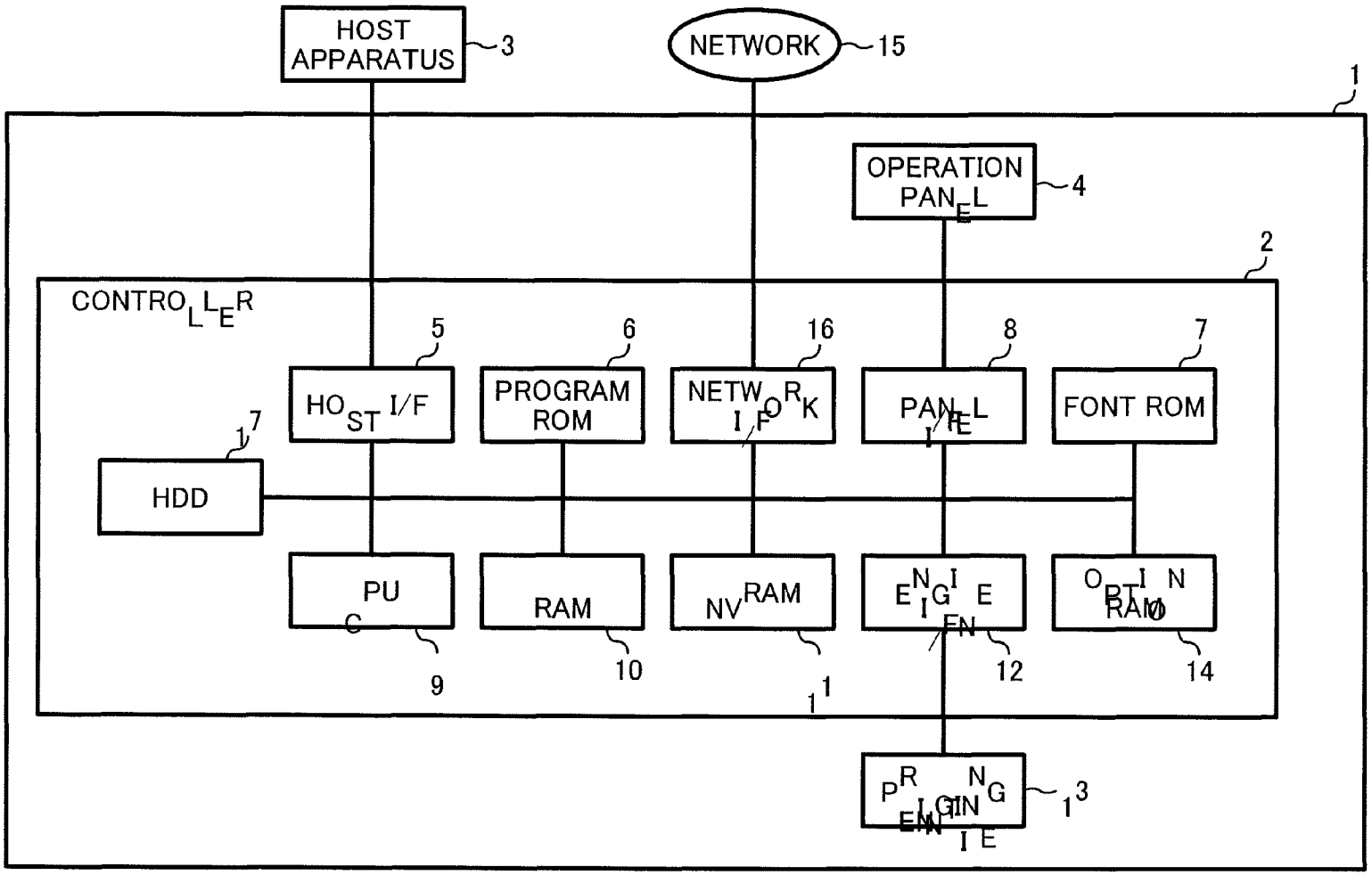
FIG. 1 is a block diagram of an image forming apparatus according to an example embodiment.

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there are no intervening elements or layers present.

Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, terms such as "below" can encompass both an orientation of above and below. The device may be otherwise oriented (rotated 90 degrees or at other orientations) and the spatially relative descriptors used herein interpreted accordingly.

Although the terms first, second, etc., may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section described below could be termed a second element, component, region, layer or section without departing from the teachings of the present invention.

The terminology used herein is for the purpose of describing exemplary embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus according to an example embodiment is described with particular reference to FIG. 1.

FIG. 1 is a block diagram of an image forming apparatus 1 according to an example embodiment. The image forming apparatus 1 may include a laser printer, for example, but is not limited to the laser printer.

As shown in FIG. 1, the image forming apparatus 1 may include a controller 2, an operation panel 4, and a printing engine 13, for example.

Furthermore, the image forming apparatus 1 may be connectable to an external apparatus or communication environment such as host apparatus 3, and a network 15, for example, via a communication network such as LAN (local area network) and the Internet, for example.

As also shown in FIG. 1, the controller 2 may include a host I/F (interface) 5, a program ROM (read only memory) 6, a font ROM (read only memory) 7, a panel I/F (interface) 8, a CPU (central processing unit) 9, a RAM (random access memory) 10, a NVRAM (non-volatile random access memory) 11, an engine I/F (interface) 12, an option RAM (random access memory) 14, a network I/F (interface) 16, and a HDD (hard disk drive) 17, for example.

The controller 2 may receive data from the host apparatus 3, convert the data, and then output the converted data to the printing engine 13.

For example, based on a control mode sent to the controller 2, or a control code (or signal) transmitted from the host apparatus 3 or network 15, the controller 2 may convert print-data transmitted from the host apparatus 3 to video data, and output the video data to the printing engine 13.

As shown in FIG. 1, the controller 2 may include a plurality of modules or units.

The operation panel 4 may include a display unit and a key unit, for example.

The display unit may display the status or condition of the image forming apparatus 1. Furthermore, the display unit may include a notification unit that may have a sound unit to produce an auditory output to convey information to a user and to acquire an auditory input to receive information from a user.

The key unit may include a plurality of keys for selecting a mode for the image forming apparatus 1 such as an operation mode and font type, for example. In this disclosure "key" and "button" may be interchangeably used, as required.

A user may check the status or condition of the image forming apparatus 1 with the display unit (or notification unit), which may display (or notify) a message, and may operate the image forming apparatus 1 with the key unit.

The host I/F 5 may function as an interface between the image forming apparatus 1 and host apparatus 3.

For example, the host apparatus 3 may transmit a control signal or data to the image forming apparatus 1 via the host I/F 5, and the controller 2 may transmit a status signal to the host apparatus 3 via the host I/F 5.

The program ROM 6 may store programs. The controller 2 may use such stored programs to process control data and to manage data and modules, for example.

The font ROM 7 may store a plurality of fonts used for printing operation.

The panel I/F 8 may interface the controller 2 and the operation panel 4.

The CPU 9 may conduct processing and controlling of a plurality of data using the programs stored in the program ROM 6.

For example, the CPU 9 may process print-data and control data, which may be transmitted from the host apparatus 3, and control modules or units in the image forming apparatus 1.

The RAM 10 may be used as a working memory for the CPU 9, a buffer memory for temporarily storing data transmitted from the host apparatus 3, and a bitmap memory storing video data, which may be obtained by converting data stored in the buffer memory to print-data.

The NVRAM 11 may store data in a non-volatile manner, by which data can be stored in the NVRAM 11 even if a power supply to the image forming apparatus 1 is set to OFF.

The engine I/F 12 may function as an interface between the controller 2 and printing engine 13.

For example, the controller 2 may transmit a control signal or video signal to the printing engine 13 via the engine I/F 12, and the printing engine 13 may transmit a status signal to the controller 2.

The printing engine 13 may receive a video signal and control signal from the controller 2, and control an image forming operation.

For example, the printing engine 13 may instruct a latent image formation on a photoconductor, developing of the latent image with a developing unit, feeding of a transfer sheet from a sheet feed unit, and transferring and fixing of the developed image on the transfer sheet.

The option RAM 14 may be used as backup memory for the RAM 10 and NVRAM 11.

The network I/F 16 may function as an interface between the network 15 and image forming apparatus 1.

For example, the image forming apparatus 1 may receive a control signal or data from the network 15 via the network I/F 16, and the image forming apparatus 1 may transmit a status signal to the network 15 via the network I/F 16.

The HDD 17 may be a large-capacity memory, which can store a larger capacity of data.

Hereinafter, a data processing in the image forming apparatus 1 is explained.

At first, the host apparatus 3 may transmit print-data to the image forming apparatus 1 via the host I/F 5.

The CPU 9 may analyze the print-data with a data-analyzing program stored in the program ROM 6. With such analysis, the print-data may be separated into printing image data and printing control data.

The print-data includes the printing image data and the printing control data.

The printing image data may include data for a to-be printed image such as a picture and a character.

The printing control data may include a control command required for printing an image. For example, such a control command, expressed in one-bite, may include SP (space), CR (carriage return), LF (line feed), HT (horizontal tab), and/or VT (vertical tab), for example.

The RAM 10 may have a data-receiving buffer memory, which may temporarily store the printing image data and printing control data.

Then, the CPU 9 may retrieve data, temporarily stored in the RAM 10 using a control program stored in the program ROM 6, and may process such retrieved data.

For example, if the retrieved data includes a character code, the CPU 9 may generate an intermediate code having a printing position, printing size, character code, and font information or the like, and store the intermediate code in an intermediate buffer memory in the RAM 10.

Furthermore, if the retrieved data includes a control code (or signal) or control command such as an escape sequence, the CPU 9 may process such control code or control command with a given procedure set in advance.

For example, if the intermediate code includes a printing position, the CPU 9 may conduct a process to designate a position of a character code, and if the intermediate code includes a font-change, the CPU 9 may change font information for a character code.

When the CPU 9 completes a processing of a print instruction, transmitted from the host apparatus 3, or when the CPU 9 processes data for more than one-page, the CPU 9 may convert the intermediate code, stored in the intermediate buffer memory, to video data with a control program.

After completing a conversion of the intermediate code, the controller 2 may transmit a print-start command to the printing engine 13 via the engine I/F 12, and also transmit video data synchronously.

With the above-described process, a printing operation may be conducted by the image forming apparatus 1. For example, the image forming apparatus 1 may conduct a printing operation by transmitting print-data generated in the host apparatus 3 to the printing engine 13.

The image forming apparatus 1 may use an electrophotography method for image forming, for example.

Figure 2:
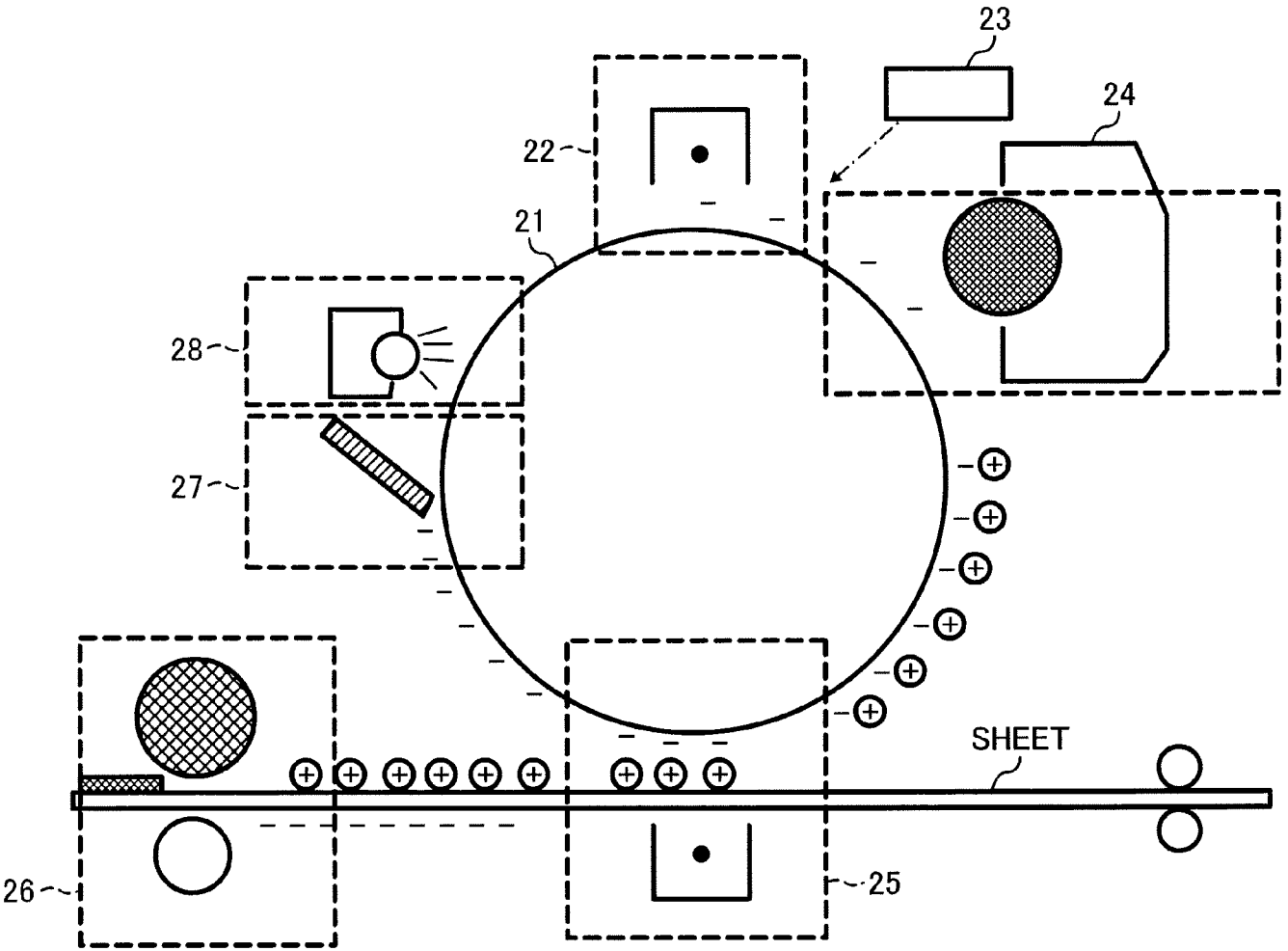
FIG. 2 is an example configuration of an image forming apparatus of FIG. 1.

In such a case, the image forming apparatus 1 may include a configuration shown in FIG. 2, in which a developing process, transfer process, and fixing process are conducted to form an image on a recording medium.

As shown in FIG. 2, such a configuration may include a photoconductor 21, a charging unit 22, a light-emitting unit 23, a developing unit 24, a transfer unit 25, a fixing unit 26, a cleaning unit 27, and a de-charging unit 28, for example.

In the developing process, the charging unit 22 may charge the photoconductor 21, and then the light-emitting unit 23 may irradiate a surface of the photoconductor 21 with a light beam to form a latent image on the photoconductor 21. The latent image may be developed as a toner image by adhering toner particles on the latent image.

In the transfer process, the toner image developed on the photoconductor 21 may be transferred to a recording medium (e.g., transfer sheet) by applying a given amount of charges to the recording medium using the transfer unit 25.

In the fixing process, the fixing unit 26 may fix the toner image on the recording medium.

With such a process, the image forming apparatus 1 may produce an image on the recording medium.

Although not shown in FIG. 2, the cleaning unit 27 may be connected to a waste toner bottle (not shown), which may store waste toner therein.

Furthermore, the fixing unit 26 may be connected to a fixing oil unit (not shown), which may supply fixing oil to the fixing unit 26.

Figure 3:
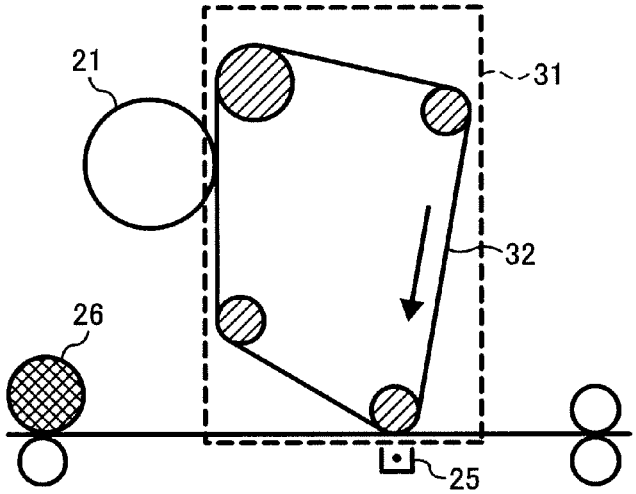
FIG. 3 is another example configuration of an image forming apparatus of FIG. 1, having an intermediate transfer unit.

Furthermore, the image forming apparatus 1 using an electrophotography method may include another configuration shown in FIG. 3, for example. Such configuration may include an intermediate transfer unit 31 having an intermediate transfer belt 32 to transfer a toner image from the photoconductor 21 to a transfer sheet.

Hereinafter, a maintenance operation (or work) for the image forming apparatus 1 at a supply-end timing is explained.

In an example embodiment, the supply-end timing may mean that a consumable supply may be already consumed or exhausted or may be almost consumed or exhausted (i.e., may be consumed or exhausted in the near future).

Hereinafter, such already or almost consumed or exhausted condition of a consumable supply may be referred as "supply-end condition of a consumable supply" or "supply-end condition," as required.

A maintenance operation (or work) for the photoconductor 21 at the supply-end condition may be conducted as described below.

In an example embodiment, the photoconductor 21 may be used for the developing process including; charging by the charging unit 22; writing by laser beam of the light-emitting unit 23; and adhering toners on a latent image. The photoconductor 21 may also be used for the transfer process including a transfer of the toner image to a recording medium.

After such a process, the cleaning unit 27, including, for example, a brush, a magnetic brush, or a blade, may remove toner remaining on the photoconductor 21. Then the photoconductor 21 may be de-charged by the de-charging unit 28 to prepare for the next image forming operation.

In the above-mentioned process, a surface of the photoconductor 21 may be abraded over time because the above-mentioned developing, transferring, cleaning, and de-charging process may be repeatedly conducted on the photoconductor 21.

If the photoconductor 21 becomes abraded, photoconductivity of the photoconductor 21 may be adversely affected, and an abrasion, such as scratch, may appear on the photoconductor 21. As a result, the image forming apparatus 1 may not produce an image having higher image quality.

Furthermore, an unfavorable condition such as over-consumption of toner or sheet jamming may occur, and may further cause a malfunction or damage to the image forming apparatus 1.

Accordingly, the photoconductor 21 may be replaced at a given timing depending on an aging level of the photoconductor 21.

The aging level of the photoconductor 21 may be detected as described below.

The CPU 9 may compute an accumulated driving time period of a motor which may drive the photoconductor 21.

Based on the accumulated driving time period, the CPU 9 may check a status or condition of the photoconductor 21 and judge a replacement timing of the photoconductor 21.

The accumulated driving time period may be stored in a memory such as a RAM 10, NVRAM 11, and option RAM 14, by which a total driving time period of the photoconductor 21 can be stored and retained in the memory even if the image forming apparatus is set to a power-OFF condition.

If CPU 9 judges that the photoconductor 21 may need a replacement immediately or in a near future based on the detected status or condition of the photoconductor 21, the CPU 9 may instruct the operation panel 4 of the image forming apparatus 1 or the host apparatus 3 to display such replacement information. Such instruction may be transmitted via a communication network such as a LAN (local area network), for example.

Such notification may be displayed or notified as a message on the operation panel 4 or on the host apparatus 3, by which a user can recognize status or condition of the photoconductor 21.

A maintenance operation (or work) for the toner may be conducted as described below.

In an example embodiment, toner may be consumed in the developing process.

Furthermore, toner may be consumed even if no image is produced on a recording medium (e.g., transfer sheet) during the developing process. For example, if a blank sheet is set and a printing operation is conducted in the image forming apparatus, no image may be formed on a recording medium.

However, even in such a case, toner may be supplied to the surface of the photoconductor 21 because the toner may function as a buffer material between the developing unit 24 and photoconductor 21 in addition to the toner's function as a developing agent.

Accordingly, if the developing process is conducted with or without an actual image forming, toner may still be consumed.

Furthermore, if the toner is totally consumed, the developing unit 24 may directly contact the photoconductor 21, depending on an internal configuration of the image forming apparatus 1.

Such direct contact of the developing unit 24 and photoconductor 21 may accelerate abrasion of the photoconductor 21, by which the photoconductor 21 may receive significant wear.

Furthermore, if photoconductor 21 is worn significantly, the toner may not effectively adhere on a charged surface of the photoconductor 21, by which the photoconductor 21 may electrostatically attract a recording medium. Such a phenomenon may cause sheet jamming more frequently.

Accordingly, if the developing process is conducted without toner, the image forming apparatus 1 may be damaged as above-mentioned in addition to a degradation of image quality.

An amount of toner remaining in the developing unit 24 may be detected by providing a toner sensor at a given position in a toner bottle (not shown), for example. Such a given position may be determined depending a shape or other factors of the toner bottle.

The toner sensor may include a weight sensor, which senses a weight of toners in a toner bottle, and a height sensor, which senses a height of toners in a toner bottle, for example.

A notification of toner refilling may be conducted as described below.

The CPU 9 may detect a remaining amount of toner using a signal coming from the toner sensor and judge the status or condition of the toner.

For example, the CPU 9 may judge a near-end or end condition of the toner. The near-end condition may mean that toner may be completely consumed in a near future, and the end condition may mean that toners may be already completely consumed.

The CPU 9 may transmit such near-end or end information to the operation panel 4 of the image forming apparatus 1 or to the host apparatus 3 via a communication network such as a LAN (local area network), for example.

The operation panel 4 or the host apparatus 3 may display (or notify) such near-end or end information as a message, for example, by which a user can recognize the status or condition of the toner.

In general, toner may be replaced with new toner by replacing a toner bottle with a new one.

Hereinafter, the photoconductor 21 and toner may be used for explaining a replacement control of consumable supplies in the image forming apparatus 1 as one example.

The photoconductor 21 and toner may have the following conditions.

For example, a time counter may count a driving-time period of the photoconductor 21. Then, the driving-time period may be converted to a number of sheets (e.g., A4 size) to be printed. A supply-end condition (or replacement timing) of the photoconductor 21 may be set to 50,000 sheets (e.g., A4 size), in which a printing operation may be conducted by feeding a sheet (e.g., A4 size) with a long-edge-feed manner.

A toner sensor may detect a remaining amount of toner in a range of 0% (no toner) to 100% (full toner) with a given incremental step such as 5%-step and 10%-step, for example. When the remaining amount of toner is detected as 0%, the toner may be replaced with new toner.

In such a condition, the printing engine 13 may receive information from the time counter and the toner sensor. As above-mentioned, the time counter may count a driving-time period of the photoconductor 21, and the toner sensor may detect a remaining amount of toner.

The time counter may count a driving-time period of a motor for driving the photoconductor 21 to compute a total driving-time period of the motor.

A driving time period of the motor may be stored in a memory such as a RAM 10, NVRAM 11, and option RAM 14, by which a driving time period of the photoconductor 21 can be stored and retained even if the image forming apparatus is set to a power-OFF condition.

Such a counted total driving-time period of the motor may be converted to a number of sheets printed during a driving-time period of the motor. In this example case, a printing operation is conducted with A4-sized sheets fed with a long-edge-feed manner.

The number of sheets counted by the time counter may be referred to as counter information, hereinafter.

The printing engine 13 may control the counter information, obtained by the above-mentioned process.

When the counter information reaches 50,000 sheets (i.e., 50,000 sheets have been printed), the printing engine 13 may store the status or condition information of the photoconductor 21.

Furthermore, the toner sensor may detect a remaining amount of toner as described below.

If the toner sensor is a weight sensor, the toner sensor may measure a weight of toner in a toner bottle to detect a remaining amount of toner.

The toner sensor may detect a remaining amount of toner in a range of 0% (no toner) to 100% (full toner) with a given incremental step such as 5%-step and 10%-step, for example.

When the remaining amount of toner is detected as 0%, the printing engine 13 may set and store a status or condition information of the toner as toner-end (or toner replacement), for example.

The printing engine 13 may transmit the counter information and toner remaining amount information to the controller 2 via the engine I/F 12. The counter information and toner remaining amount information may be referred to as detected information, hereinafter, as required.

The controller 2 may transmit the detected information to the operation panel 4, and the operation panel 4 displays (or notifies) such detected information as a message. Such a message may include replacement information of the photoconductor 21 and toner, for example.

Figure 4:
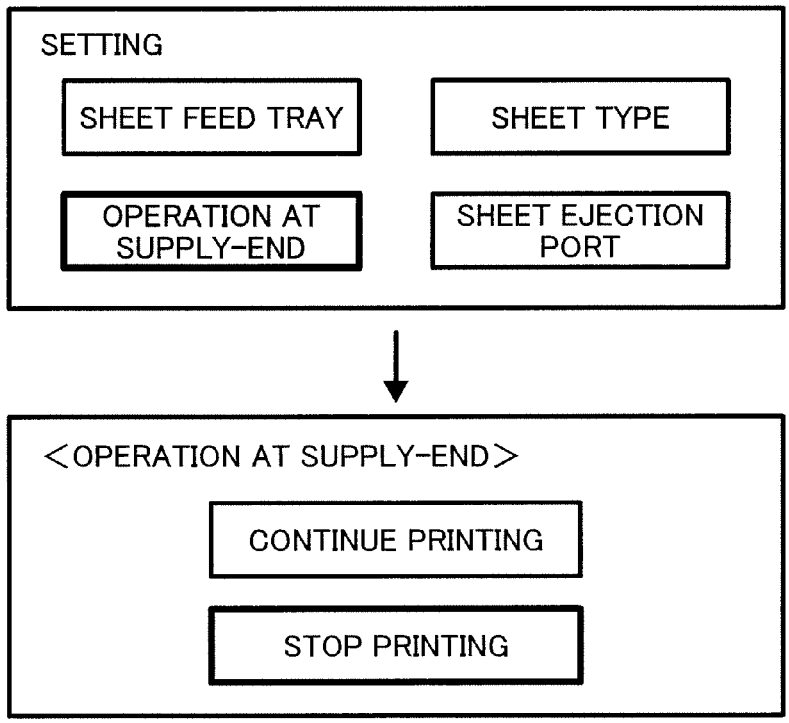
FIG. 4 is an example display view for notifying selectable settings when a supply-end condition of consumable supplies occurs.

FIG. 4 is an example display view of selectable settings on the operation panel 4 for notifying when a supply-end condition of a consumable supply occurs.

As shown in FIG. 4, the operation panel 4 of the image forming apparatus 1 may display (or notify) selectable settings to a user. When the user selects one setting, the corresponding setting may be stored in a memory such as a NVRAM 11.

In an example embodiment shown in FIG. 4, the selectable settings may include a setting for stop/continue option of a printing operation when a supply-end condition of a consumable supply occurs.

Similarly, such a message may also be displayed (or notified) on a view screen of the host apparatus 3, which may be connected to the image forming apparatus 1 via a LAN, for example. A user may select one setting from such a view screen, for example.

Furthermore, the printing engine 13 may similarly detect a replacement status or condition of other consumable supplies such as a developing unit 24, a fixing unit 26, and fixing oil. The printing engine 13 may transmit such detected information to the controller 2 similarly as in the photoconductor 21 and toner.

The controller 2 may transmit such detected information to the operation panel 4, and the operation panel 4 may display (or notify) such detected information as a message.

Specifically, if the operation panel 4 receives information including a replacement timing of consumable supplies from the controller 2, the operation panel 4 may display (or notify) a warning or error message.

Figure 5:
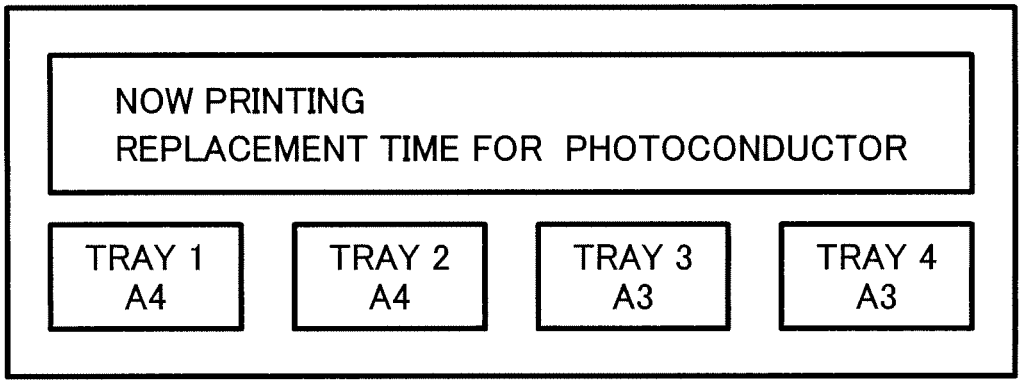
FIG. 5 is an example display view for a warning/error message on an operation panel.
Figure 5:
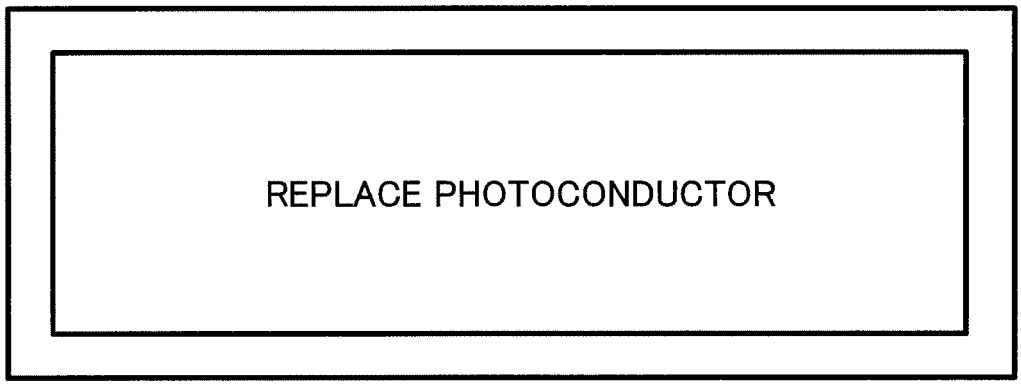

FIG. 5 is an example display view of a warning/error message on the operation panel 4.

In an example embodiment, a warning and error message may be defined as described below.

The "warning" may mean that a user may be notified of a supply-end condition of a consumable supply, but an image forming process such as a printing operation can be continued.

The "error" may mean that a user may be notified of a supply-end condition of a consumable supply and an image forming process such as a printing operation may be stopped.

As such, in an example embodiment, a user can select stop/continue option of a printing operation when a supply-end condition of a consumable supply occurs depending on a need of a user.

For example, a user may select to stop a printing operation if the user's intention is a higher image quality, or a user may select to continue a printing operation if the user's intention is to reduce a downtime of the image forming apparatus 1 (e.g., reducing a waiting time for replacing a consumable supply) although image quality may be degraded.

Hereinafter, the above-described control process in the image forming apparatus 1 is explained with reference to FIG. 6.

In an example embodiment, Table 1 (below) may show a category or types of consumable supplies, for which a user can select to stop or continue a printing operation.

As shown in Table 1, the stop/continue option of a printing operation may be set for a consumable supply, which may not cause image quality degradation or apparatus damage.

However, the stop/continue option of a printing operation cannot be set for a consumable supply, which may cause image quality degradation or apparatus damage.

For example, toner or a waste toner bottle is set only with a "stop printing" for a supply-end condition of the toner or the waste toner bottle.

The supply-end condition of toner may mean that toner in a toner bottle may be totally consumed.

The supply-end condition of a waste toner bottle may mean that the waste toner bottle may be filled with waste toner and cannot receive any more waste toner.

If the printing operation is still continued under such a supply-end condition of the toner or waste toner bottle, the image forming apparatus may be damaged.

TABLE 1

| Consumable-Supply | Settable operation |
|---|---|
| Toner K | Stop printing |
| Toner Y | Stop printing |
| Toner C | Stop printing |
| Toner M | Stop printing |
| Waste toner bottle | Stop printing |
| Developing unit | Stop/Continue Printing |
| Photoconductor unit | Stop/Continue Printing |
| Transfer unit | Stop/Continue Printing |
| Intermediate transfer unit | Stop/Continue Printing |
| Fixing unit | Stop/Continue Printing |
| Fixing oil unit | Stop/Continue Printing |

A control process in the image forming apparatus 1 when a supply-end condition of consumable supplies occurs is explained below.

Any processes, descriptions, or blocks in flow charts should be understood as representing modules, segments, portions of code which include one or more executable instructions for implementing specific logical functions or steps in the process, and alternate implementations are included within the scope of the exemplary embodiment of the present invention in which functions may be executed out of order from that shown or discussed, including substantially concurrently or in reverse order, depending upon the functionality involved, as would be understood by those skilled in the art.

Figure 6:
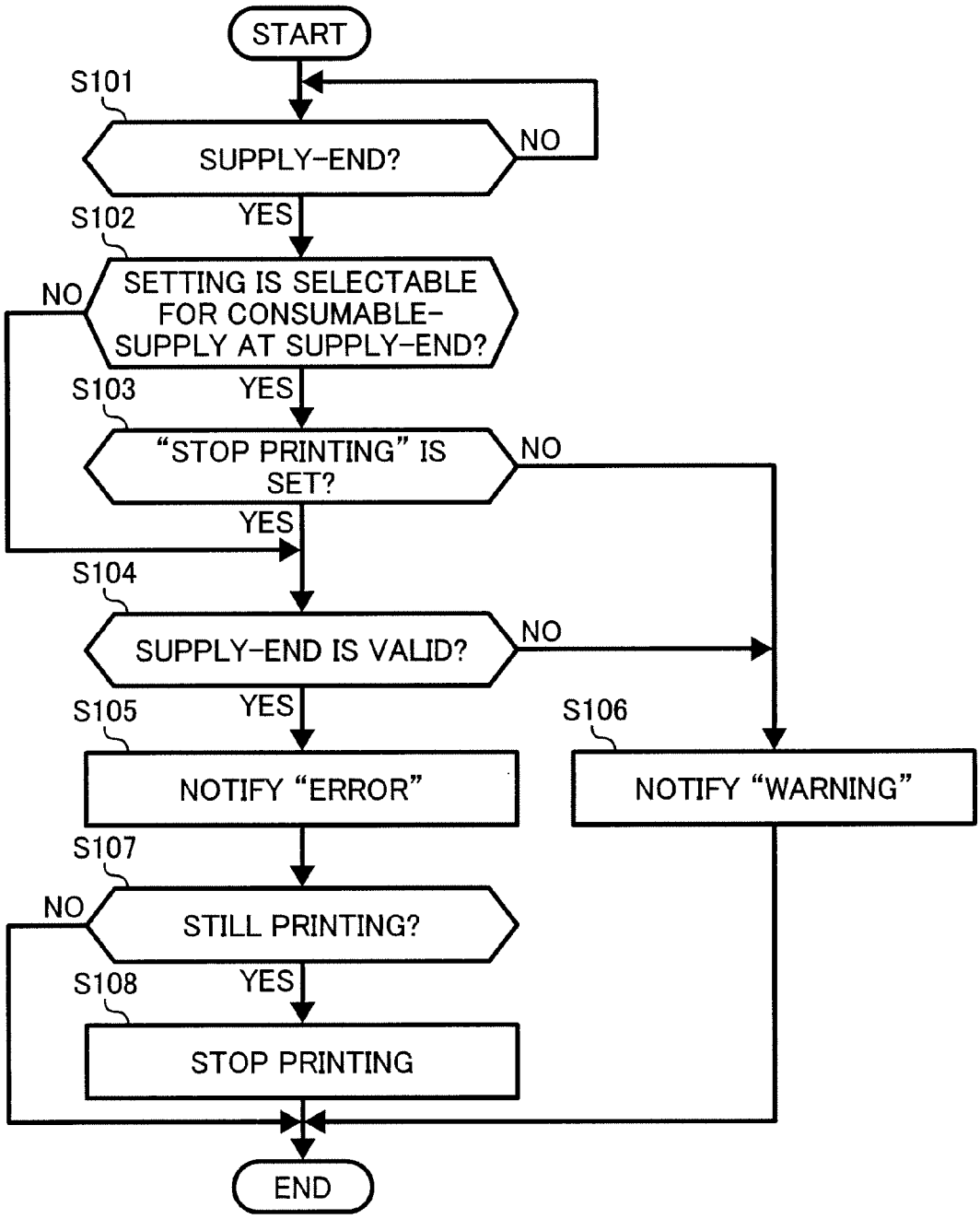
FIG. 6 is a flowchart explaining a control process in an image forming apparatus when a supply-end condition of consumable supplies occurs.

FIG. 6 is a flowchart explaining a control process in the image forming apparatus 1 when a supply-end condition of consumable supplies occurs.

At step S101, the CPU 9 checks whether a supply-end condition of a consumable supply occurs.

Specifically, the CPU 9 checks whether the printing engine 13 transmits a signal, indicating that a supply-end condition of a consumable supply has occurred (e.g., the remaining amount of a consumable supply becomes 0%), to the CPU 9.

If the CPU 9 confirms that the supply-end condition of a consumable supply does not occur (No at step S101), the CPU 9 allows a continuation of a printing operation and waits for a signal indicating that a supply-end condition of a consumable supply is occurring.

If the CPU 9 confirms that the supply-end condition of a consumable supply occurs (Yes at step S101), the process goes to step S102.

At step S102, the CPU 9 checks whether the consumable supply at a supply-end condition corresponds to a category for which a stop/continue option of a printing operation is selectable by referring to the above-mentioned Table 1.

If the CPU 9 confirms that the consumable supply at a supply-end condition corresponds to a category for which a stop/continue option of a printing operation is selectable (Yes at step S102), the process goes to step S103.

At step S103, the CPU 9 checks a setting for the consumable supply stored in the NVRAM 11.

Specifically, the CPU 9 checks whether the setting for the consumable supply at supply-end condition is set to "stop printing" at step S103.

If the CPU 9 confirms that the setting for the consumable supply at supply-end condition is not set to "stop printing" (No at step S103), the process goes to step S106.

At step S106, the CPU 9 displays, for example, a "warning" message on the operation panel 4, and the CPU 9 allows a continuation of a printing operation at step S106.

If the CPU 9 confirms that the setting for the consumable supply at the supply-end condition is set to "stop printing" (Yes at step S103), the process goes to step S104.

Furthermore, if the CPU 9 confirms that the consumable supply at the supply-end condition does not correspond to a category for which a stop/continue option of a printing operation is selectable (No at step S102), the process goes to step S104.

At step S104, the CPU 9 checks whether the supply-end condition of the consumable supply is valid or invalid.

Such valid or invalid checking at step S104 may be related to a maintenance agreement for the image forming apparatus to be explained later.

For example, such valid or invalid checking at step S104 may be defined by a maintenance agreement, which may be prepared and agreed by a user/maker.

In some maintenance agreements, a supply-end condition of the consumable supply may be set to invalid.

If the CPU 9 confirms that the supply-end condition of the consumable supply is invalid (No at step S104), the process goes to step S106.

If the consumable supply at the supply-end condition is set with a "stop printing" setting at step S103, and then at step S104, the CPU 9 confirms that the "stop printing" setting is invalid, then the process goes to step S106.

If the consumable supply at the supply-end condition can only have a "stop printing" setting at step S102 (No at step S102), and then at step S104 the CPU 9 confirms that the "stop printing" setting is invalid, then the process goes to step S106.

At step S106, the CPU 9 displays a "warning" message on the operation panel 4.

If the CPU 9 confirms that the supply-end condition of the consumable supply is valid (Yes at step S104), the process goes to step S105. Specifically, at step S104, the CPU 9 confirms that the "stop printing" setting is valid.

At step S105, the CPU 9 displays an "error" message on the operation panel 4, and the process goes to step S107.

At step S107, the CPU 9 checks whether the image forming apparatus 1 is still continuing a printing operation.

If the CPU 9 confirms that the image forming apparatus 1 is still continuing the printing operation (Yes at step S107), the process goes to step S108.

At step S108, the CPU 9 conducts a "stop printing" process.

The "stop printing" process may mean that the CPU 9 instructs the printing engine 13 to stop a sheet feed operation or a sheet ejection operation, for example.

Furthermore, the CPU 9 instructs the printing engine 13 to continue a printing operation for print-data which is already received by the printing engine 13 before the above-described steps S101 to S108 are conducted.

Furthermore, the CPU 9 instructs a restart of a printing operation to the printing engine 13 if a supply-end condition of the consumable supply is released (or canceled) by replacing the consumable supply with a new one.

If the CPU 9 confirms that the image forming apparatus 1 is not in a printing condition (No at step S107), the process completes.

As also shown in FIG. 6, the process also completes after step S106 (warning message is notified) or step S108 (printing is stopped).

Then, the CPU 9 waits for a next signal indicating a supply-end condition of a consumable supply.

As shown in FIG. 6, if the supply-end condition of a consumable supply occurs and the CPU 9 detects that a supply-end condition of the consumable supply is valid and sets "stop printing," the CPU 9 displays an "error" message on the operation panel 4.

Such an "error" message may be distinguishable from a "warning" message, wherein a printing operation is able to continue during a display of a "warning" message.

Therefore, a user can recognize that the consumable supply needs a replacement with an "error" message. Thus, the user is not puzzled about whether a replacement of the consumable supply is required or not.

Hereinafter, a printing operation of the image forming apparatus 1 when the supply-end condition of a consumable supply is released (or canceled) is explained with reference to FIG. 7.

Figure 7:
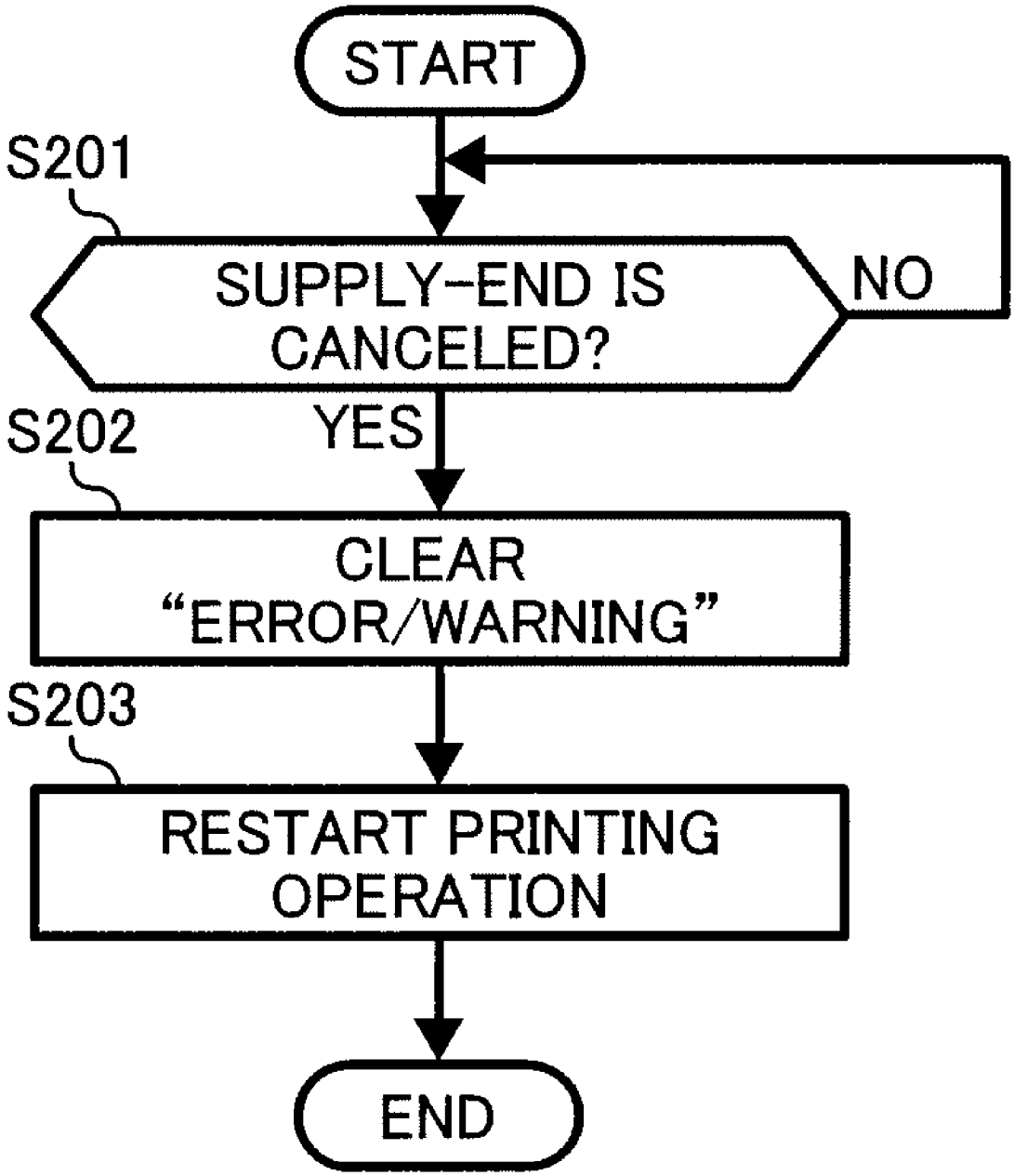
FIG. 7 is a flowchart explaining a process in an image forming apparatus when a supply-end condition of consumable supplies is released (or canceled)

As shown in FIG. 7, at step S201, the CPU 9 checks whether the printing engine 13 transmits a signal, indicating that a consumable supply is released (or canceled) from a supply-end condition, to the CPU 9.

If a consumable supply is in the supply-end condition, the printing engine 13 transmits a signal indicating that the consumable supply is in the supply-end condition (i.e., the remaining amount of the consumable supply is 0%) to the CPU 9.

However, if the consumable supply is not in the supply-end condition, the printing engine 13 transmits a signal, indicating that the consumable supply is released (or canceled) from the supply-end condition, to the CPU 9. In other words, the printing engine 13 transmits a signal indicating that the remaining amount of the consumable supply is a value other than 0%.

Accordingly, at step S201, the CPU 9 checks whether a supply-end condition of a consumable supply is released (or canceled).

If the CPU 9 confirms that the supply-end is not released (or canceled) (No at step S201), the CPU 9 waits for a signal which indicates a release (or cancellation) of the supply-end condition of the consumable supply.

If the CPU 9 confirms that the supply-end condition of the consumable supply is released (or canceled) (Yes at step S201), the process goes to step S202.

At step S202, the CPU 9 clears the error/warning message displayed on the operation panel 4.

At step S203, the CPU 9 instructs the printing engine 13 to restart a suspended printing operation if the printing operation was suspended because a supply-end condition of the consumable supply has occurred.

The supply-end condition of the consumable supply may be released (or canceled) by conducting a replacement/refilling of the consumable supply when the printing operation is suspended.

When the CPU 9 confirms that a supply-end condition of the consumable supply is released (or canceled), the CPU 9 restarts a suspended printing operation.

With such a configuration, a suspended printing operation may be resumed while a user may not need to transmit print-data again after replacing/refilling a consumable supply. Such a configuration may be preferable to reduce inconvenience for a user.

Figure 8:
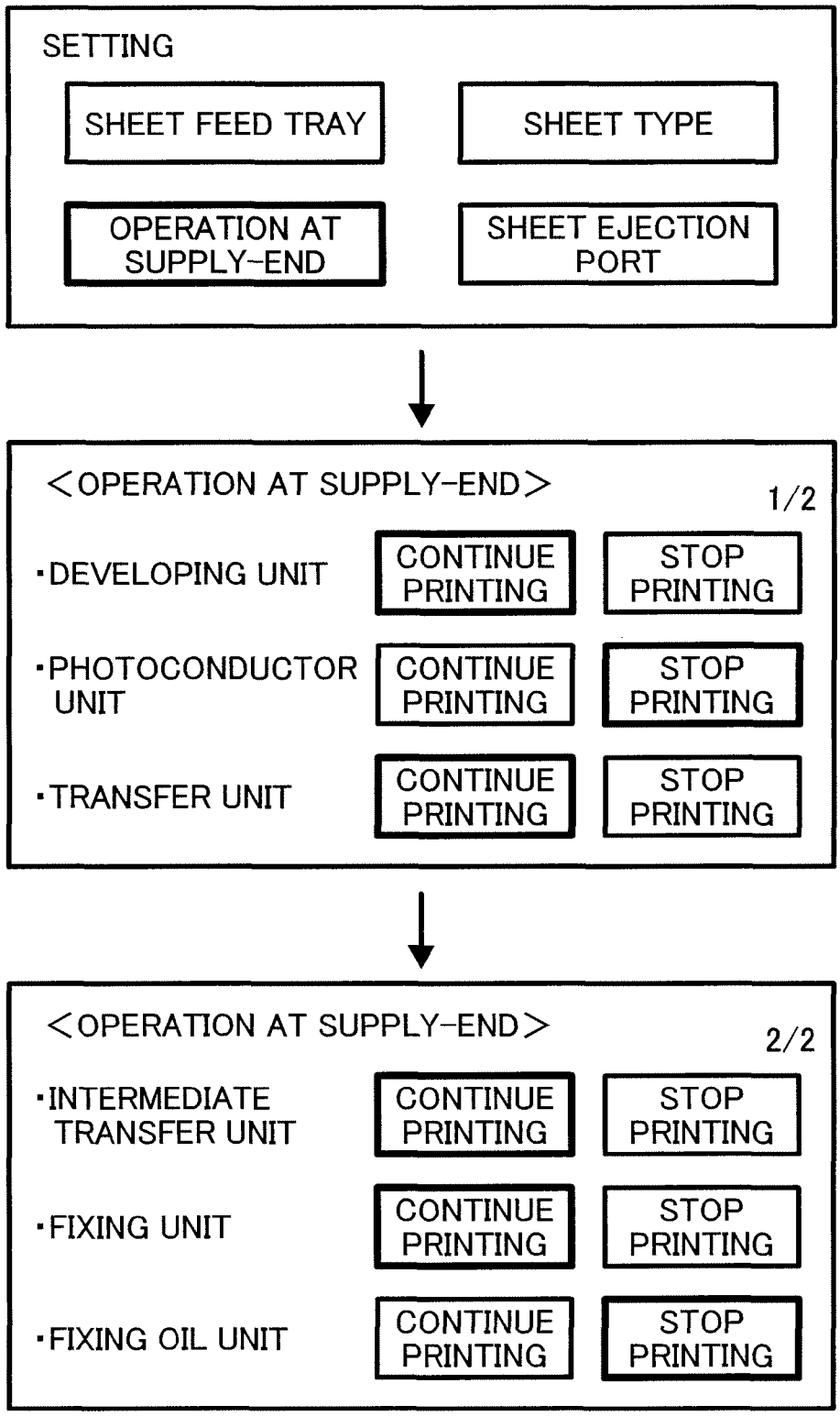
FIG. 8 is another example display view for notifying selectable settings when a supply-end condition of consumable supplies occurs.

As shown in FIG. 8, a stop/continue option of a printing operation may be set for each consumable supply separately from the operation panel 4, and the setting for each consumable supply may be stored in a memory such as a NVRAM 11.

Accordingly, at step S103 in FIG. 6, the CPU 9 can set a stop/continue option of a printing operation for each consumable supply by referencing a setting for each consumable supply stored in a memory such as a NVRAM 11.

As such, a stop/continue option of a printing operation may be settable for each consumable supply independently.

Such a feature may enhance or increase the setting patterns for a consumable supply.

For example, if one consumable supply may affect the printing engine 13 by a small amount, and if another consumable supply may require a longer period of time for obtaining a spare part, the CPU 9 may set only a "warning" message for such a consumable supply.

Then, if a supply-end condition (or replacement timing) occurs for such a consumable supply during a printing operation, the CPU 9 may display a "warning" message on the operation panel 4 for the consumable supply at the supply-end condition, and allow a continuation of the printing operation.

Furthermore in an example embodiment, as shown in FIG. 8, the operation panel 4 may display a consumable supply, of which a stop/continue option of a printing operation can be set.

In other words, the operation panel 4 may not display a consumable supply for which a stop/continue option of a printing operation cannot be set. Such a consumable supply may correspond to the consumable supply having only a "stop printing" setting in Table 1.

If the consumable supply having only a "stop printing" setting enters into a supply-end condition, but the image forming apparatus 1 still continues a printing operation under such a supply-end condition, the printing engine 13 may be damaged.

Therefore, if a consumable supply having only a "stop printing" setting enters into a supply-end condition, the image forming apparatus 1 may stop a printing operation.

With such a configuration, whenever the consumable supply which may cause damage to the printing engine 13 enters into a supply-end condition (or replacement timing), the CPU 9 may display an "error" message on the operation panel 4 and stop a printing operation.

Therefore, a user cannot forget the replacement timing of such a consumable supply. Thus, the printing engine 13 will not be damaged.

Furthermore, a user can selectively set a stop/continue option of a printing operation when a supply-end condition of a consumable supply occurs based on a maintenance agreement of the image forming apparatus 1 prepared by a maker/user.

In this case, settings defined by the maintenance agreement may be stored in a memory such as a NVRAM 11.

Accordingly, at step S104 in FIG. 6, the CPU 9 may refer to settings defined by the maintenance agreement and stored in the NVRAM 11.

Such settings may include a setting so that a user may not need to conduct a maintenance operation (or work) for a given consumable supply. In other words, the user and maker can select a consumable supply which does not have to be replaced by the user based on a maintenance agreement.

A maintenance agreement for an image forming apparatus (e.g., a copier) between a user/maker may include a term which assures the performance quality of an image forming apparatus. Such a maintenance agreement may also have a term defining roles of the user and the maker regarding a maintenance operation (or work) of an image forming apparatus.

For example, in one maintenance agreement, the maker may arrange for a customer engineer (CE) to conduct a maintenance operation (or work) of an image forming apparatus periodically, and a user may not be required to perform such a maintenance operation (or work).

In such a case, the customer engineer (CE) may visit the user periodically and check on the latest status (e.g. total number of printed sheets) of the image forming apparatus, and may replace a consumable supply which is in a near-end condition during such a maintenance visit.

In such a case, a user may not need a notification of an "error" message or a process for "stop printing", even if a supply-end condition of a consumable supply may occur.

Furthermore, because the customer engineer (CE) may conduct a maintenance operation (or work) of a consumable supply periodically, the user may not need to conduct such a maintenance operation (or work).

Accordingly, under such a maintenance agreement, the user may not be bothered by an "error" message, which requires a replacement of the consumable supply at the supply-end condition, and the user may not be bothered by a downtime of the image forming apparatus due to the supply-end condition of the consumable supply, for example.

Under such a condition, at step S104 in FIG. 6, the CPU 9 checks whether a supply-end condition of a consumable supply is valid or invalid by referencing a memory such as a NVRAM 11 storing data, prepared from a maintenance agreement, which sets the roles of the customer engineer (CE) and the user.

If the CPU 9 confirms that the customer engineer (CE) conducts a maintenance operation (or work) of a consumable supply, instead of a user, the CPU 9 may instruct the operation panel 4 not to display or send a message relating to a printing operation condition at a supply-end condition of a consumable supply, or may instruct the operation panel 4 to display or notify a message relating to a printing operation condition at a supply-end condition of a consumable supply with a lower light intensity.

If a maintenance agreement has a term defining that substantially all of the maintenance operations (or work) are conducted by a customer engineer (CE), settings for each consumable supply in Table 1 may be set to "continue printing," for example.

As such, depending on the contents of a maintenance agreement, the operation panel 4 may not display a message or setting relating to a printing operation condition at a supply-end condition of a consumable supply.

In such a case, a user may not be bothered by information relating to a printing operation condition at a supply-end condition of a consumable supply.

At step S105 in FIG. 6, the CPU 9 displays an "error" message on the operation panel 4.

In this case, the CPU 9 instructs the host I/F 5 and network I/F 16 not to receive new data while setting an error condition in the image forming apparatus 1.

The CPU 9 can set such an error condition in the image forming apparatus 1 when a supply-end condition of a consumable supply occurs during a printing operation or during a non-printing operation.

For example, such a non-printing operation may include when the image forming apparatus 1 is supplied with power, or when a photoconductor 21 is activated for adjusting image forming conditions (e.g., color adjustment) during a stand-by period.

In such a case, the CPU 9 may not receive new data, which may be transmitted from the host apparatus 3.

Accordingly, the CPU 9 may stop a data-transmission from the host apparatus 3 to the image forming apparatus 1 because the image forming apparatus 1 cannot conduct a printing operation due to a supply-end condition of a consumable supply.

With such a configuration, even if a user may try to send data from the host apparatus 3 to the image forming apparatus 1, such data may not be transmitted to the image forming apparatus 1. Accordingly, the image forming apparatus 1 having a consumable supply at a supply-end condition may not be jammed by the data transmission.

Figures 9, 9A:
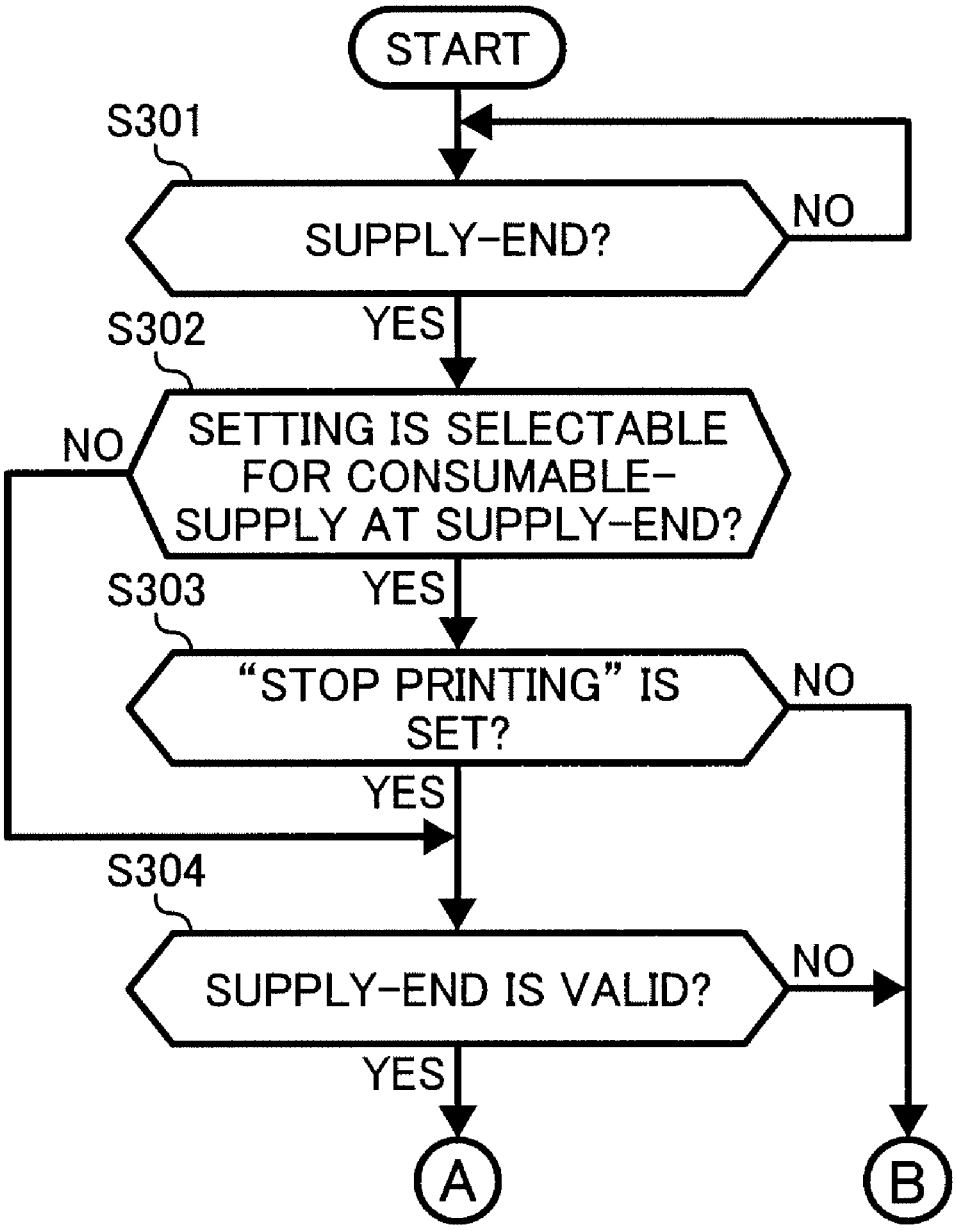
FIGS. 9A and 9B comprise a flowchart explaining a control process for an image forming apparatus when a supply-end condition of consumable supplies occurs, in which a suspended printing operation is selectably restarted or reset.
Figure 9B:
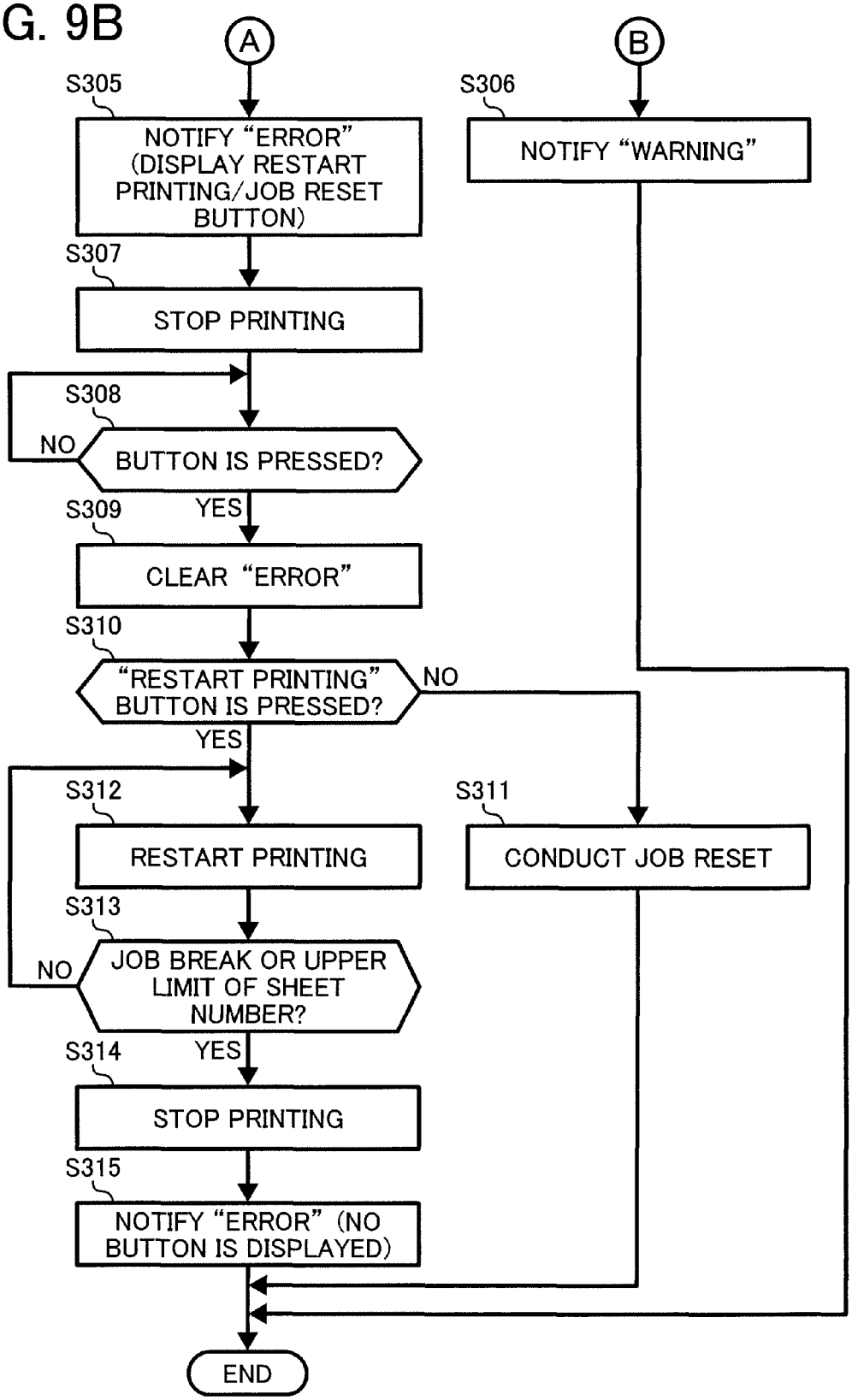

Hereinafter, a control process from a time when a supply-end condition of a consumable supply occurs to a time when a "restart printing/job reset" is set is explained with the flowchart of FIG. 9.

At step S301, the CPU 9 checks whether a supply-end condition of a consumable supply occurs during a printing operation.

Specifically, the CPU 9 checks whether the printing engine 13 transmits a signal, indicating a supply-end condition of a consumable supply (e.g., the remaining amount of a consumable supply becomes 0%), to the CPU 9.

If the CPU 9 confirms that the supply-end condition of the consumable supply does not occur (No at step S301), the CPU 9 allows a continuation of a printing operation and waits for a signal indicating that a supply-end condition of a consumable supply has occurred.

If the CPU 9 confirms that the supply-end condition of the consumable supply occurs (Yes at step S301), the process goes to step S302.

At step S302, the CPU 9 checks whether the consumable supply at the supply-end condition corresponds to a category for which a stop/continue option of a printing operation is selectable by referencing the above-mentioned Table 1.

If the CPU 9 confirms that the consumable supply at the supply-end condition corresponds to a category for which a stop/continue option of a printing operation is selectable (Yes at step S302), the process goes to step S303.

At step S303, the CPU 9 checks a setting for the consumable supply stored in the NVRAM 11.

Specifically, the CPU 9 checks whether the setting for the consumable supply at the supply-end condition is set to "stop printing" at step S303.

If the CPU 9 confirms that the setting for the consumable supply at the supply-end condition is not set to "stop printing" (No at step S303), the process goes to step S306.

At step S306, the CPU 9 displays a "warning" message on the operation panel 4, and the CPU 9 allows a continuation of a printing operation at step S306.

If the CPU 9 confirms that the setting for the consumable supply at the supply-end condition is set to "stop printing" (Yes at step S303), the process goes to step S304.

Furthermore, if the CPU 9 confirms that the consumable supply at the supply-end condition does not correspond to a category for which a stop/continue option of a printing operation is selectable (No at step S302), the process goes to step S304.

At step S304, the CPU 9 checks whether the supply-end condition of the consumable supply is valid or invalid.

If the CPU 9 confirms that the supply-end condition of the consumable supply is invalid (No at step S304), the process goes to step S306.

The above-mentioned steps S301 to S306 are similar to steps S101 to S106 in FIG. 6.

If the CPU 9 confirms that the supply-end condition of the consumable supply is valid (Yes at step S304), the process goes to step S305. Specifically, at step S304, the CPU 9 confirms that the "stop printing" setting is valid.

At step S305, the CPU 9 displays an "error" message on the operation panel 4.

Figure 10:
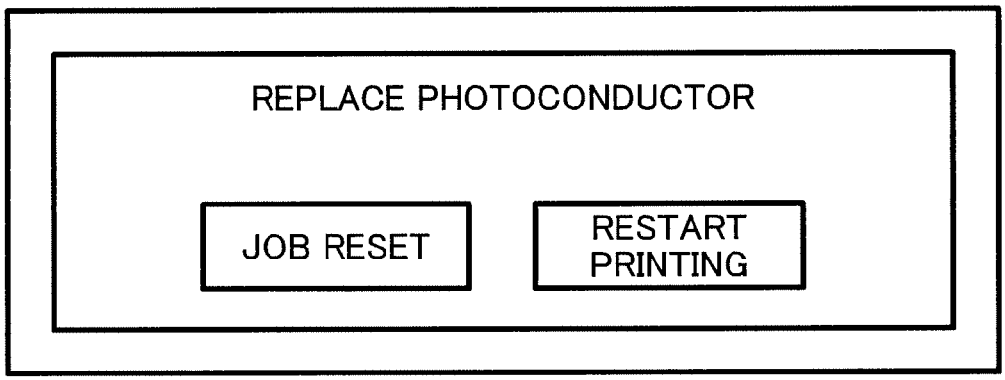
FIG. 10 is an example display view of a "restart printing" button and a "job reset" button on an operation panel.

At step S305, the CPU 9 displays the "error" message with a "restart printing" button and a "job reset" button on the operation panel 4 as shown in FIG. 10.

In an example embodiment, the "restart printing" button and the "job reset" button may be included in the operation panel 4 as a touch key. However, such a button may be provided as a hard key, which may be specially provided for an image forming apparatus.

After step S305, the process goes to step S307.

At step S307, the CPU 9 stops a printing operation, and the process goes to step S308.

At step S308, the CPU 9 checks whether a button on the operation panel 4 is pressed.

If the CPU 9 confirms that the button is not pressed (No at step S308), the CPU 9 waits until a user presses a button on the operation panel 4. Specifically, a user may press a button to input a command to the image forming apparatus 1.

In an example embodiment, the CPU 9 sets the "restart printing" button and the "job reset" button on the operation panel 4, for example. However, the types and number of buttons may be changed, as required.

If the CPU 9 confirms that the button is pressed (Yes at step S308), the CPU 9 clears the "error" message on the operation panel 4 at step S309.

At step S310, the CPU 9 checks which button is pressed on the operation panel 4.

If the CPU 9 confirms that the "restart printing" button is not pressed (No at step S310), the CPU 9 judges that the "job reset" button is pressed at step S310, and the process goes to step S311.

At step S311, the CPU 9 conducts a job reset for the image forming apparatus 1.

If the CPU 9 confirms that the "restart printing" button is pressed (Yes at step S310), the process goes to step S312.

At step S312, the CPU 9 restarts a suspended printing operation, which is suspended due to a supply-end condition of the consumable supply.

Specifically, the CPU 9 restarts a suspended printing operation by sending a command for restarting the suspended printing operation to the printing engine 13.

After restarting the suspended printing operation at step S312, the CPU 9 checks a job break or upper limit of a sheet number at step S313.

The upper limit of the sheet number may mean a number of sheets which are printable when the suspended printing operation is resumed.

The CPU 9 detects a job break using a signal at step S313. For example, the CPU 9 may detect a job break by detecting a job-start or job-end command in one job; and the CPU 9 may detect a job break when the CPU 9 does not receive job data for a given time period.

Furthermore, the CPU 9 may detect a job break for one job when a printing operation, which prints a group of sheets, is temporally stopped.

For example, the CPU 9 may command the image forming apparatus 1 to print four sets of a three-page document. In this case, one job includes a printing of twelve sheets. Under such a condition, the CPU 9 can set a job break for each three-sheet printing, by which the CPU 9 may judge that a job break comes at each three-sheet printing.

As such, the CPU 9 may detect a job break without limiting a job type and job break methods.

The upper limit of a sheet number which are printable when a supply-end condition of the consumable supply occurs will be explained later.

If the CPU 9 detects a job break (Yes at step S313), the process goes to step S314.

At step S314, the CPU 9 stops the printing operation again, and then the process goes to step S315.

At step S315, the CPU 9 displays an "error" message on the operation panel 4 but does not display the "restart printing" button and the "job reset" button, which is different from step S305.

A printing operation suspended (or stopped) at step S307 can be restarted at step S312 and conducted until the process goes to step S314. However, the printing operation is stopped after step S314.

After steps S314 and S315, such once-stopped and resumed printing operation cannot be resumed once again until the consumable supply is replaced or refilled.

As explained above, the CPU 9 allows the resumed printing operation at step S312 if a consumable supply at a supply-end condition does not cause damage to the image forming apparatus 1.

Although such resumed printing operation may cause some damage to the image forming apparatus 1, from a viewpoint of reducing a downtime of the image forming apparatus 1, the above-mentioned resumed printing operation may be acceptable.

However, it is not preferable to continue such a resumed printing operation for a relatively long period of time from a viewpoint of reducing possible damage to the image forming apparatus 1.

Therefore, as explained above, the CPU 9 allows the resumed printing operation at step S312 for one time only, but stops the resumed printing operation at step S314 to reduce damage to the image forming apparatus 1.

After step S315, the CPU 9 maintains a display of an "error" message on the operation panel 4 until a replacement or refilling of the consumable supply is conducted.

Furthermore, the upper limit of a sheet number which are printable when a suspended printing operation is resumed may be settable in the image forming apparatus 1 as below.

For example, a setting for an "upper limit of a sheet number" may be added to the settings for a consumable supply. Such a new setting may be added to Table 1, for example.

A user may set or select a number of printable sheets to the "upper limit of a sheet number".

Then, the CPU 9 may store such an "upper limit of a sheet number" information to a memory such as a NVRAM 11.

If the CPU 9 allows a restart of a suspended printing operation at step S312, the CPU 9 checks a job break and an "upper limit of a sheet number" at step S313.

When the CPU 9 checks the "upper limit of a sheet number" at step S313, the CPU 9 counts a number of sheets (referred as "counted-sheet-number", hereinafter), which are printed in a resumed printing operation.

Then, the CPU 9 compares a counted-sheet-number with the "upper limit of sheet number" at step S313.

If the CPU 9 confirms that the counted-sheet-number becomes the "upper limit of sheet number" (Yes at step S313), the process goes to step S314.

At step S314, the CPU 9 stops the printing operation again.

At step S315 and thereafter, the CPU 9 maintains a display of the "error" message on the operation panel 4.

If the CPU 9 does not detect a job break or if the CPU 9 confirms that the counted-sheet-number does not become the "upper limit of a sheet number" (No at step S313), the process goes back to step S312.

As such, in an example embodiment, the image forming apparatus 1 can continue or restart a printing operation, which is suspended (or stopped) due to a supply-end condition of the consumable supply, by selecting a button for continuing a printing operation displayed on the operation panel 4.

With such configuration, a user may choose a continuation of a printing operation even if a supply-end condition of a consumable supply occurs when the user hastily needs to print a document file although image quality may be somewhat degraded in such printing.

Furthermore, the image forming apparatus 1 has a job reset button as shown in FIG. 10, by which a user can cancel a printing operation of classified documents or the like at a desired timing so that such documents are not printed against a user's will.

Furthermore, the CPU 9 may stop a resumed printing operation at the above-explained job break or upper limit of a sheet number, by which the image forming apparatus 1 may not be damaged even if the suspended printing operation is resumed.

For example, assume that 1) a user sets "ten (10) sheets" as an upper limit of a sheet number, 2) the image forming apparatus 1 is conducting a printing operation of a 100-page document, 3) a supply-end condition of a consumable supply occurs when the image forming apparatus 1 prints out pages 1 to 3 (i.e., three sheets), and 4) the CPU 9 stops the printing operation of the 100-page document (i.e., 97 pages are not printed).

If the user selects "restart printing" button at this stage, the CPU 9 may allow a suspended printing operation to be resumed.

However, the CPU 9 may not allow a resumed printing operation to be conducted for the remaining 97 pages, but allows a 10-page printing (i.e. a total of 13-pages of the 100-page document are printed) based on the setting (i.e., ten sheets) of the "upper limit of a sheet number."

With such a configuration, the image forming apparatus 1 may not print a larger volume of sheets in a printing operation when a supply-end condition of a consumable supply occurs, by which damage to the image forming apparatus 1 may be reduced or suppressed.

Similarly to the upper limit of a sheet number, the above-explained job break may be applied to reduce or suppress damage to the image forming apparatus 1 when the image forming apparatus 1 conducts a resumed printing operation.

For example, assume that the image forming apparatus 1 receives data for a first printing operation (for a 10-page document) and a second printing operation (for a 5-page document) at one time. If a supply-end condition of a consumable supply occurs during the first printing operation, the first printing operation may be suspended. For example, the first printing operation may be suspended when the image forming apparatus printed pages 1 to 8 (i.e., printing pages 9 and 10 is suspended).

If a restart of the suspended first printing operation is selected, the controller restarts and completes the suspended first printing operation (i.e., printing pages 9 and 10 is completed).

However, the controller does not allow the second printing operation for the 5-page document because a relatively longer restarted printing operation may cause damage to the image forming apparatus 1.

In general, the smaller the number of an upper limit of a sheet number or job break, the lesser the chance for damage to the image forming apparatus 1.

As explained above, in an example embodiment, a user can select a stop/continue option of a printing operation when a supply-end condition of a consumable supply occurs in the image forming apparatus 1.

With the above-explained configuration, the image forming apparatus 1 may be effective to reduce or suppress a degradation of image quality of the printed sheets, and may be effective to reduce a downtime of the image forming apparatus 1. The downtime is a time period between a stop of a printing operation and a replacement of a consumable supply.

As explained above, a user can select an image quality and a time issue related to downtime, as required.

Numerous additional modifications and variations are possible in light of the above teachings. It is therefore to be understood that within the scope of the appended claims, the disclosure of the present invention may be practiced otherwise than as specifically described herein.

This application claims priority from Japanese patent application No. 2005-375091 filed on Dec. 27, 2005 in the Japan Patent Office, the entire contents of which is hereby incorporated by reference herein.

What is claimed is:

1. An image forming apparatus, comprising;

a plurality of consumable supplies including a first consumable supply and a second consumable supply, wherein the second consumable supply is a different type from the first consumable supply;

a setting unit configured to independently set a print-stop setting or a print-continue setting for each of the consumable supplies;

a sensor configured to detect a supply condition of at least one of the consumable supplies;

a notification unit configured to convey a message based on the supply condition detected by the sensor; and a controller configured, when the sensor detects the supply condition, to suspend a printing operation based on the print-stop setting or to continue the suspended printing operation based on the print-continue setting, wherein, when the printing operation is suspended due to an occurrence of the supply condition of a particular one of the consumable supplies during the printing operation, the notification unit conveys a message that the printing is suspended due to the supply condition of the particular one of the consumable supplies, wherein the setting unit sets at least one of the print-stop setting and the print-continue setting for each of the consumable supplies separately, and wherein the print-stop setting and the print-continue setting set for each of the consumable supplies are selectively used for the printing operation, which is suspended due to the occurrence of the supply condition, wherein the controller is configured to refer to an agreement-based setting for the image forming apparatus to determine whether the print-stop setting or the print-continue setting set by the setting unit for at least one of the consumable supplies is valid or invalid, and the agreement-based setting is defined by a maintenance agreement for the image forming apparatus, and wherein, based on the agreement-based setting, the controller is configured to instruct the notification unit to convey the print-stop setting or the print-continue setting with a lower light intensity for at least one of the consumable supplies.

2. The image forming apparatus according to claim 1, wherein, when the printing operation is suspended due to the occurrence of the supply condition of the particular one of the consumable supplies during the printing operation and then the particular one of the consumable supplies at the supply condition is replaced with a new one, the controller restarts the suspended printing operation.

3. The image forming apparatus according to claim 1, wherein the setting unit sets the print-continue setting for a first type of the consumable supplies and does not set the print-continue setting for a second type of the consumable supplies, wherein the first type of the consumable supplies at the supply condition causes little damage to the image forming apparatus when the controller restarts the suspended printing operation, and the second type of the consumable supplies causes damage to the image forming apparatus when the controller restarts the suspended printing operation.

4. The image forming apparatus according to claim 1, wherein, based on the agreement-based setting, the controller is configured to instruct the notification unit not to convey the print-stop setting or the print-continue setting for at least one of the consumable supplies.

5. The image forming apparatus according to claim 3, wherein, when the printing operation is suspended due to an occurrence of the supply condition of the second type of the consumable supplies during the printing operation, the controller rejects data received from an external apparatus until the second type of the consumable supplies is replaced with a new one, and the controller instructs the notification unit to notify a message corresponding to a data-not-receiving condition.

6. The image forming apparatus according to claim 1, wherein, when the printing operation is suspended due to the occurrence of the supply condition during the printing operation and then the printing operation is selectively stopped, the controller instructs the notification unit to convey a print-restart setting and a job reset setting.

7. The image forming apparatus according to claim 1, wherein the first consumable supply is one of toner, a waste toner bottle, a developing unit, a photoconductor unit, or a transfer unit and the second consumable supply is a different one of the toner, the waste toner bottle, the developing unit, the photoconductor unit, or the transfer unit.

8. The image forming apparatus according to claim 6, wherein, when the image forming apparatus receives data for a first printing operation and a second printing operation and then the occurrence of the supply condition suspends the first printing operation in progress and then the print-restart setting is selected for the suspended first printing operation, the controller is configured to restart the suspended first printing such that the first printing operation is completed, but the controller does not allow the second printing operation to be operated.

9. The image forming apparatus according to claim 6, wherein the controller sets an upper limit of a printable sheet number for the image forming apparatus, the upper limit of a printable sheet number limits a number of sheets to be printed by a printing operation which is restarted by the print-restart setting after being stopped due to the occurrence of the supply condition, and wherein, when the image forming apparatus receives data for a third printing operation, an occurrence of the supply condition suspends the third printing operation in progress, and the print-restart setting is selected for the suspended third printing operation, then the controller is configured to restart the suspended third printing operation and begin counting a number of sheets printed by the restarted third printing operation until a number of sheets of the restarted third printing operation becomes equal to the upper limit of a printable sheet number such that the controller stops the third printing operation when the number of sheets of the restarted third printing operation is equal to the upper limit.

10. The image forming apparatus according to claim 1, wherein the notification unit includes a display unit to produce a visual output.

11. The image forming apparatus according to claim 1, wherein the notification unit includes an audible unit to produce and receive audio information.

12. An image forming apparatus, comprising;

a plurality of consumable supplies including a first consumable supply and a second consumable supply, wherein the second consumable supply is a different type from the first consumable supply;

means for independently setting a print-stop setting or a print-continue setting for each of the consumable supplies;

means for detecting a supply condition of at least one of the consumable supplies;

means for conveying a message based on the supply condition detected by the means for sensing;

means for setting a condition for the image forming apparatus based on the message; and means for controlling, when the means for detecting detects the supply condition, a suspended printing operation based on the print-stop setting or the print-continue setting wherein, when the printing operation is suspended due to an occurrence of the supply condition of a particular one of the consumable supplies during the printing operation, the means for conveying conveys a message that the printing is suspended due to the supply condition of the particular one of the consumable supplies, wherein the means for independently setting sets at least one of the print-stop setting and the print-continue setting for each of the consumable supplies separately, and wherein the print-stop setting and the print-continue setting set for each of the consumable supplies are selectively used for the printing operation, which is suspended due to the occurrence of the supply condition, wherein the means for controlling is configured to refer to an agreement-based setting for the image forming apparatus to determine whether the print-stop setting or the print-continue setting set by the means for setting for at least one of the consumable supplies is valid or invalid, and the agreement-based setting is defined by a maintenance agreement for the image forming apparatus, and wherein, based on the agreement-based setting, the means for controlling is configured to instruct the means for conveying to convey the print-stop setting or the print-continue setting with a lower light intensity for at least one of the consumable supplies.

13. The image forming apparatus according to claim 12, wherein the first consumable supply is one of toner, a waste toner bottle, a developing unit, a photoconductor unit, or a transfer unit and the second consumable supply is a different one of the toner, the waste toner bottle, the developing unit, the photoconductor unit, or the transfer unit.

14. A method of managing a printing condition and consumable supplies for an image forming apparatus, comprising;

sensing a supply condition of any of the consumable supplies, the consumable supplies including a first consumable supply and a second consumable supply, wherein the second consumable supply is a different type from the first consumable supply;

independently setting a print-stop setting or a print-continue setting for each of the consumable supplies;

conveying a message based on the supply condition detected by the sensing, the conveying including conveying a message that the printing is suspended due to the supply condition of a particular one of the consumable supplies when the printing operation is suspended due to an occurrence of the supply condition of the particular one of the consumable supplies;

providing an operation key used for setting a condition for the image forming apparatus based on the message, the providing including setting at least one of the print-stop setting and the print-continue setting for each of the consumable supplies separately, and the print-stop setting and the print-continue setting set for each of the consumable supplies are selectively used for the printing operation, which is suspended due to the occurrence of the supply condition;

when the sensing detects the supply condition, controlling a suspended printing operation based on the print-stop setting or the print-continue setting, the controlling including referring to an agreement-based setting for the image forming apparatus to determine whether the print-stop setting or the print-continue setting set for at least one of the consumable supplies is valid or invalid, and the agreement-based setting is defined by a maintenance agreement for the image forming apparatus; and based on the agreement-based setting, conveying the print-stop setting or the print-continue setting with a lower light intensity for at least one of the consumable supplies.

15. The method according to claim 14, wherein the first consumable supply is one of toner, a waste toner bottle, a developing unit, a photoconductor unit, or a transfer unit and the second consumable supply is a different one of the toner, the waste toner bottle, the developing unit, the photoconductor unit, or the transfer unit.

* * * * *